United States Patent [19]

Cook

[11] Patent Number: 4,678,136

[45] Date of Patent: Jul. 7, 1987

[54] SUSPENDED CREEL

[75] Inventor: Donald A. Cook, Gainesville, Ga.

[73] Assignee: Coronet Industries, Inc., Atlanta, Ga.

[21] Appl. No.: 874,470

[22] Filed: Jun. 16, 1986

[51] Int. Cl.[4] ..... B65H 49/14; B65H 57/06; B65H 57/16

[52] U.S. Cl. ..... 242/131; 19/105; 19/159 R; 19/236; 19/243; 57/90; 57/352; 242/157 R

[58] Field of Search ..... 242/131, 131.1, 130, 242/129.5, 129.53, 129.62, 129.72, 137.1, 140, 157 R; 57/90, 352; 28/190, 193, 198, 199; 19/159 R, 159 A, 105, 236, 243

[56] References Cited

U.S. PATENT DOCUMENTS

| | | | |
|---|---|---|---|
| 3,126,695 | 3/1964 | McGill | 57/18 |
| 3,133,335 | 5/1964 | Whalon et al. | 19/243 X |
| 3,457,596 | 7/1969 | Whitehurst | 19/243 |
| 3,596,851 | 8/1971 | Vincoli | 242/131 |
| 4,150,800 | 4/1979 | Clausen et al. | 242/131 |
| 4,299,359 | 11/1981 | Shelton | 242/131 |
| 4,572,458 | 2/1986 | Bluhm et al. | 242/131 |

*Primary Examiner*—Stanley N. Gilreath

*Attorney, Agent, or Firm*—Fleit, Jacobson, Cohn & Price

[57] ABSTRACT

A relatively heavy sliver creel frame is suspended from an overhead support by relatively stiff wires whose angle to the creel in combination with the weight of the creel minimize horizontal creel sway. A pair of additional stabilizing links connect the creel to and cantilever it from a support structure spaced from the floor region over which the creel is suspended.

9 Claims, 3 Drawing Figures

SUSPENDED CREEL

This invention relates to creels and more particularly to creels from which yarns are fed.

In the manufacture of yarns particularly in the carpet industry, fiber filaments are combed into parallel lengths in a composite bundle known as a "tow" or "sliver." The filaments are formed into slivers by a carding machine which combs the fibers parallel and combines a plurality of slivers into a composite single sliver or strand. A dozen or so slivers are then combined in a second carding machine, and so on, to provide 100–200 doublings. For example, ten slivers are combined to form a single sliver. Those ten slivers are combined with ten other similar slivers to form 100 doublings. Two such 100 doublings are combined into a single sliver to form 200 doublings.

Each sliver is stored coiled in a can which may be about four feet in height and about two to three feet in diameter. To combine, for example, 12 such slivers in a single carding machine, 12 cans with their coiled slivers are placed in an array adjacent a sliver creel for guiding the slivers through eyelets attached to the creel. One or more slivers may be passed through a given eyelet which feeds and aligns the slivers into the inlet of a given carding machine.

Present creels are floor mounted and the posts supporting such creels hamper the efficiency of placement of the different cans during the carding process. Such creels tend to interfere with the process in that as the cans empty they need to be replaced with full cans. Because of the many other cans in the region adjacent the carding machine and the creel, it is not easy to manipulate the empty cans out of place and replace them with full cans. Often several full cans are fed serially so that the end of the sliver in one can is attached to an end of a sliver in a next adjacent can to provide a relatively long run of the sliver from the single sliver strand formed by the two cans. Therefore, it is common for two dozen or more cans to be placed in a region adjacent the feed portion of a carding machine.

Because of the interference of the creel supports with the location of the sliver cans, the normal practice is to place the cans outside the region of the posts, wasting considerable floor space. In addition, it is important that the tension on the slivers be somewhat uniform to preclude breaking or stretching the relatively fragile sliver fibers which are normally held together by friction. Therefore, some alignment is required of the slivers as they are processed through the eyelets of the creel into the carding machine. This alignment requirement also provides restriction on the location of the sliver storage cans. The present inventor has recognized that a more efficient process is provided by a creel in which the floor mounting posts may be dispensed with. However, the present inventor also recognizes that suspending a creel is not a simple matter in that factory ceilings tend to be relatively high, e.g., more than 30 feet and the continuously moving slivers passing through and frictionally engaged with the creel eyelets may tend to cause the suspended creel to sway. Such sway can cause variation in tension on the slivers being combed. Such tension variations can cause potential failure, breakage or stretching of the slivers during feeding into the carding machine. A need, therefore, is recognized for a suspended creel which is simple, low cost and yet relatively stable.

A relatively stable suspended creel according to the present invention comprises a frame having a given weight. A plurality of yarn guide elements are secured to the frame. A plurality of wires of a given stiffness are attached at one end thereof to the frame in spaced relation and at the other end to a support in spaced relation in crisscross fashion to suspend the frame from the support via the force of gravity. The wires are secured to the frame at an angle of less than about 75° to the horizontal. The angle, wire stiffness and weight of the frame are such that the frame tends to resist swaying in response to an applied horizontal force caused by the friction engagement of yarn with the guide elements through which the yarns pass.

Figure 1:
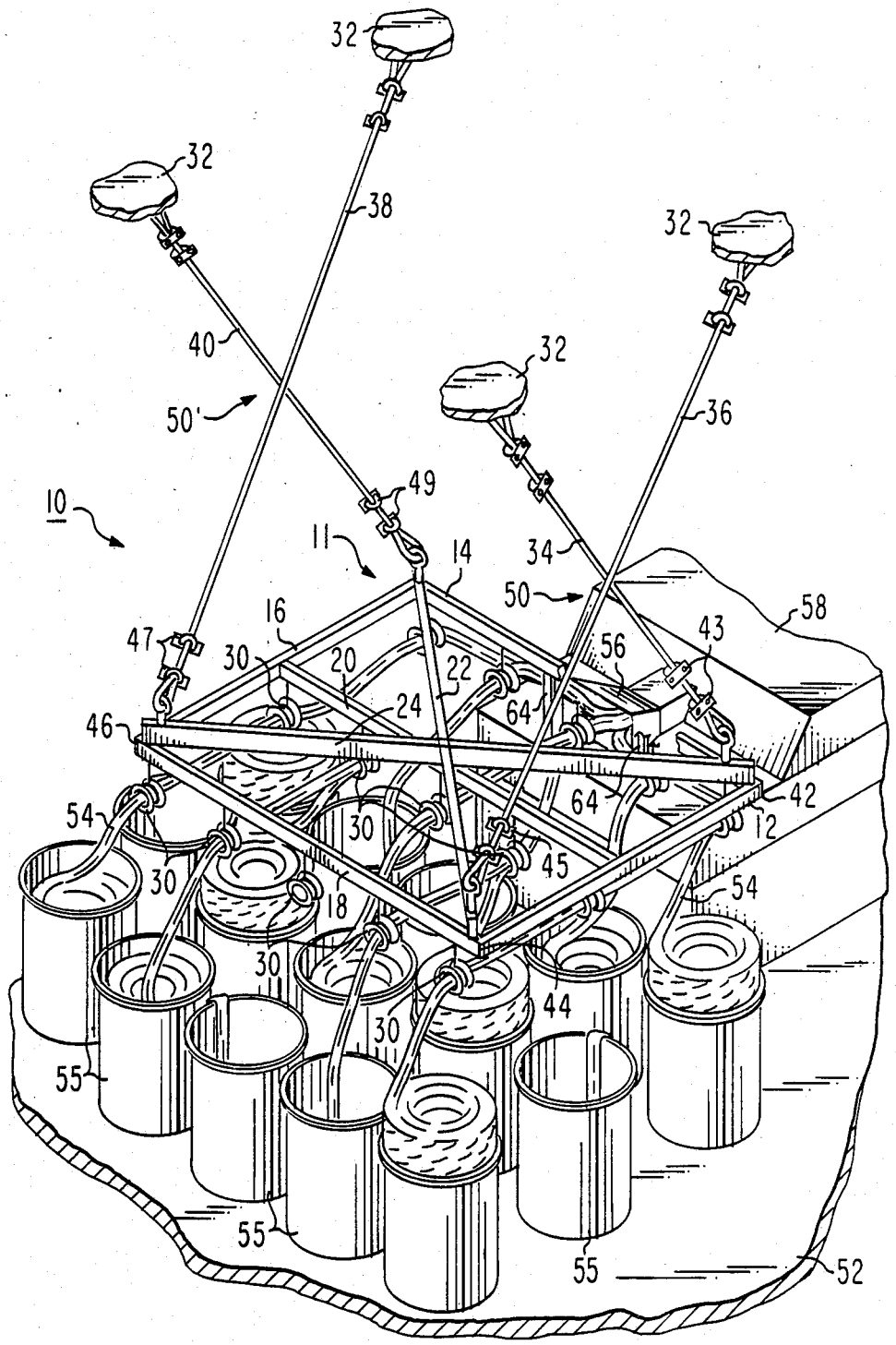
FIG. 1 is an isometric view of a creel according to one embodiment of the present invention.

In FIG. 1, creel 10 comprises a frame 11 formed of a plurality of ribs 12, 14, 16, and 18 joined at their ends into a rectangular open frame structure. The ribs 12–18 may be made of the same material, for example, iron stock. A rib 20 is secured to ribs 12 and 16 centrally of and parallel to ribs 14 and 18. Rib 22 is attached at its ends to the respective diagonal corners of the frame 11. A second diagonal rib 24 is interlocked with rib 22 and attached at its ends to opposite corners of frame 11. Ribs 22 and 24 are centrally attached to rib 20. A plurality of ceramic sliver guide eyelets 30 are attached to and depend beneath the ribs.

The frame 11 is suspended from a ceiling 32 with a set of four wires 34, 36, 38, and 40. Wires 34, 36, 38, and 40 are preferably the same diameter solid single strand filaments of sufficiently large diameter so as to be relatively stiff, e.g., 3/16 diameter steel. By stiffness is meant the wires tend to exhibit some resilience and spring-like quality. That is, they tend to return to the unstressed position when bent from that position. This is compared to a limp string which has negligible latent spring forces when bent. The wires may also be stranded wire ropes of a diameter which tends to be relatively stiff as compared to hemp, cotton, jute ropes of the same diameter. The latter tend to be relatively weak in response to bending forces and exhibit negligible latent spring force when bent. The wire diameter may be greater than 3/16-inch. However, the wires are somewhat bendable as compared to rigid relatively larger diameter steel rods for a given length which may functionally serve as posts. Stiffness is a function of length. The greater the length of a wire for a given diameter the greater its bendability within its elastic limit, i.e., the greater one end can displace relative to the other end without permanent deformation. A rigid structure such as a stanchion or post tends to exhibit relatively negligible bending of one end relative to the other end. In contrast, a 3/16-inch diameter wire extending over a ceiling-to-creel 30 foot length, for example, is extremely bendable and somewhat spring-like in characteristics. Relatively large diameter rigid posts or complex strut structures in comparison could provide the desired stability to frame 11 over such a ceiling-to-creel distance. Such structures, however, tend to be heavy, cumbersome and more costly for the large ceiling-to-creel lengths involved. The use of rigid posts or strut structures should be distinguished from a suspension system wherein a suspension system hangs via gravity and tends to be subject to significant sway. Posts and rigid strut structures are not subject to significant sway. Significant sway in the present environment is undesirable.

Wire 34 is connected at one end to frame 11 corner 42 via clamps 43. Wire 36 is connected to corner 44 via clamps 45, wire 38 is connected to corner 46 via clamps 47, and wire 40 is connected to corner 48 via clamps 49. The other upper ends of the wires are clamped to the ceiling 32 or intermediate structure secured to the ceiling. The frame 11 is substantially horizontal. The wires 34 and 36 appear to crisscross in a central region 50 as viewed in directions 62, FIG. 2, in a location spaced above rib 12. Wires 38 and 40 appear to crisscross in a central region 50' in a location spaced above rib 16. The distance between the ceiling 32 and the frame normally might be about 30 feet, the drawing figures not being to scale. The frame 11, FIG. 1, is suspended above the floor 52 the usual height for guiding slivers 54 from cans 55 into the inlet 56 of a carding machine 58. Frame 11 is about 6–7 feet above floor 52. The wires preferably are like material. The entire creel structure comprising the wires and frame weighs about 100 pounds.

Figure 2:
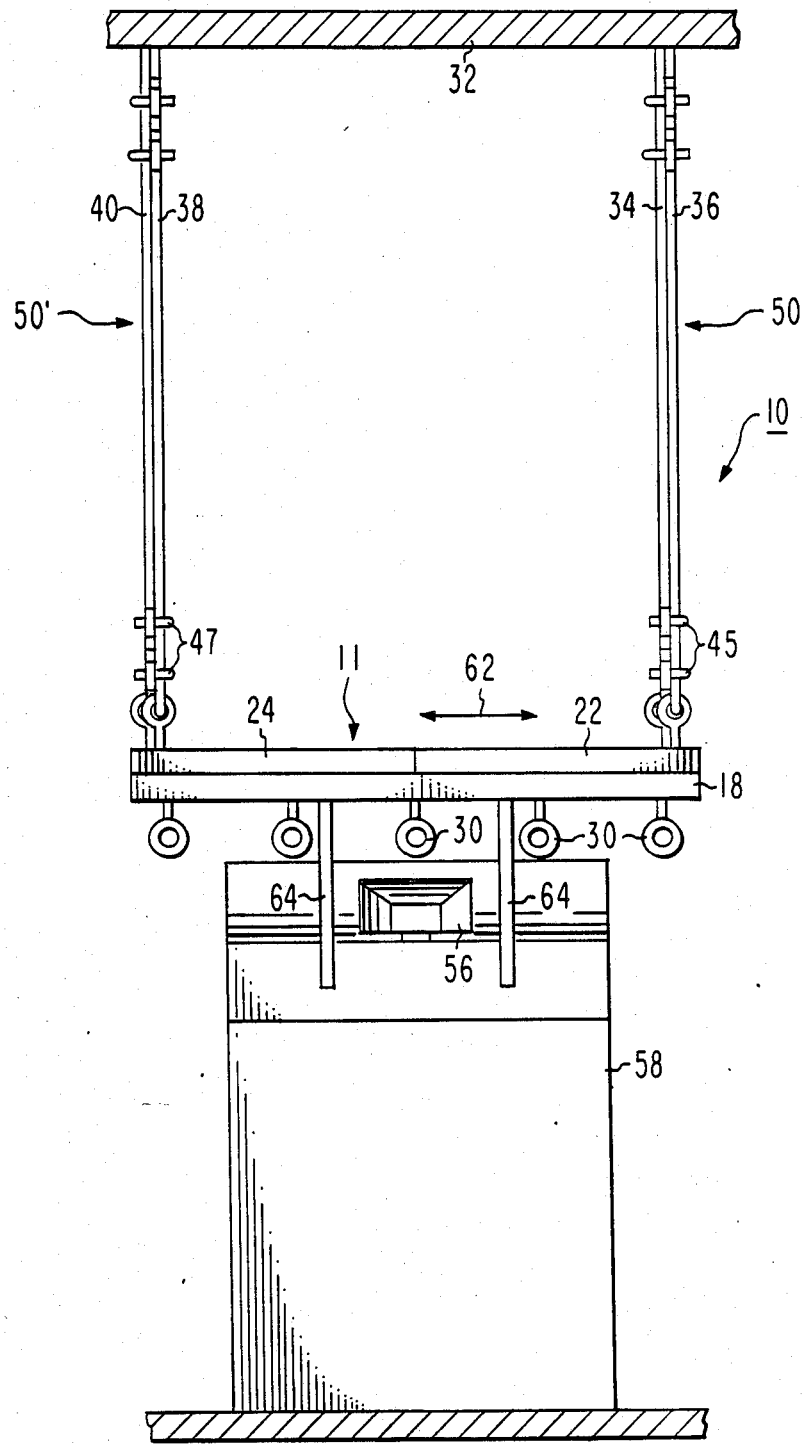
FIG. 2 is an end view of the creel of FIG. 1 without the sliver storage cans and slivers in place.
Figure 3:
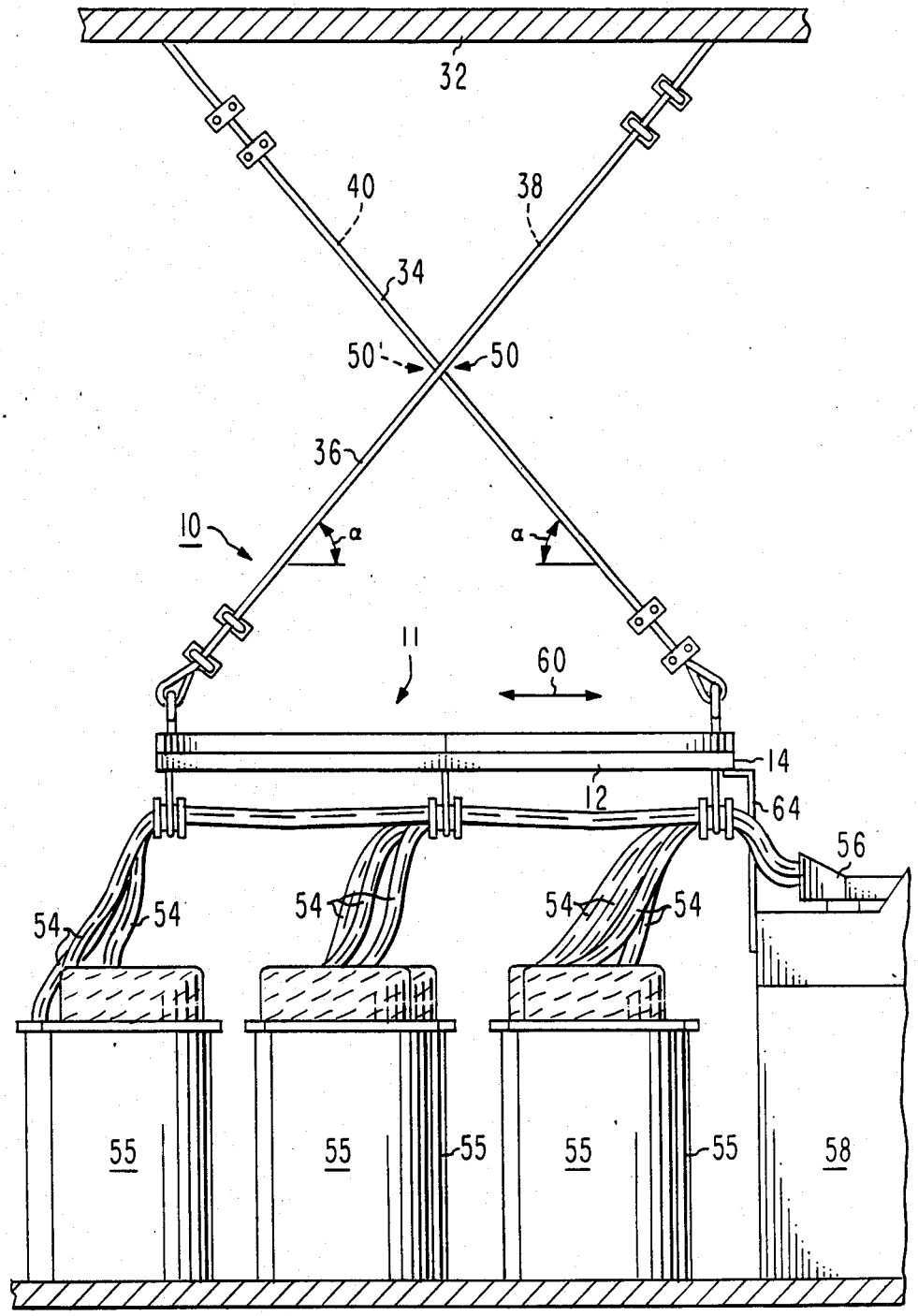
FIG. 3 is a side elevation view of the creel system of FIG. 2 with slivers and storage cans.

In FIG. 3, wires 34, 36, 38, and 40 may be at the same angle $\alpha$, for example, less than 75°, and preferably about 65° with the horizontal. Wires 34 and 36 lie in adjacent planes which are parallel to the force of gravity as best seen in FIG. 2. Wires 38 and 40 lie in adjacent planes which also are parallel to the force of gravity. Angle $\alpha$, FIG. 3, is set at a value which tends to stabilize the creel 10 sufficiently relative to the ceiling 32 so that it exhibits maximum resistance to sway in the horizontal directions 60.

It is believed that the reason the creel 10 exhibits maximum resistance to sway in horizontal directions 60 is attributed, in part, to the angular strut arrangement of the wires 34, 36, 38, and 40, the stiffness of the wires and the weight of the creel frame structure. Because of the angular relationship of the wires, any horizontal displacement of the frame structure in directions 60 in response to friction forces between the slivers and guide eyelets tends to swing the frame structure about an arc and thus lift the structure vertically against the force of gravity. That angle $\alpha$ which results in a significant vertical displacement in response to a given horizontal displacement is the maximum optimum angle value. At that point the weight of the frame structure needs to be lifted a significant vertical distance for a given horizontal displacement of the frame 11 which lifting tends to resist and counteract the sway forces. The 3/16-inch diameter wire, because it is a single strand and relatively stiff, provides additional stiffness to the system. The value of angle $\alpha$ is a function of the distance between ceiling 32 and creel frame 11, FIG. 1, and the length of frame 11, FIG. 3, in directions 60. For a given distance between frame 11 and ceiling 32, angle $\alpha$ is inversely proportional to the frame 11 length. The smaller the angle $\alpha$ the stiffer and more stable the system.

For the above reasons, a creel structure of relatively heavy material is more desirable than a creel structure of lighter material to minimize sway in directions 60. The directions 60 are significant because one of directions 60 is the direction the slivers are fed into the carding machine 58. The transverse direction normal to directions 60 is not as much of a problem as relatively smaller forces are applied to the creel by the slivers fed in such directions during operation. Therefore, in the transverse directions, the wires can hang in a plane normal to the horizontal. However, if additional stability is desired in the transverse directions, the wires can also extend at an angle less than 90° in transverse directions 62, FIG. 2, relative to the horizontal.

A pair of rigid connecting links 64, FIGS. 2 and 3, are attached to rib 14 and to the frame of carding machine 58 for further stabilization. Machine 58 is next to, but not beneath the area of the floor over which the creel is suspended. Thus, the creel is cantilevered from the links 64 which are out of the way of cans 55. While two links are shown, more or fewer connecting links 64 may be provided. In practice, such connecting links provide stability to the frame 11 in combination with the other factors described above. The links are off the floor in the region beneath the creel and therefore do not interfere with the placement of the sliver cans. The distance between the ceiling represented by symbols 32 and the creel 10 is not critical, as the angular relationship of the wires to the creel and ceiling can be set accordingly. The important factor is that the creel is suspended off the floor 52 providing ample room for manipulation of the sliver cans in production environments.

While a passive creel is disclosed, the suspension system of the present invention is equally applicable to active creels, e.g., of the type disclosed in U.S. Pat. No. 4,150,800. In active creels, motorized sliver drive units are secured to the creel frame for providing a friction drive force on the slivers for pulling the slivers from their respective cans.

What is claimed is:

1. A suspended creel comprising:

a frame having a given weight;

a plurality of yarn guide elements secured to the frame; and a plurality of wires of a given stiffness attached at one end thereof to the frame in spaced relation and adapted to be attached at the other end to an overhead support in spaced relation in crisscross fashion to suspend the frame from the support via the force of gravity, said wires each being secured to the frame structure at an angle of less than about 75° to the horizontal, the angle, wire stiffness and weight of the frame being such that the frame tends to resist swaying in response to an applied horizontal force caused by the friction engagement of yarns with the guide elements through which the yarns pass.

2. The creel of claim 1 further including a stabilizing member secured to the frame adapted to be secured to a support in a region outside the area projected by the frame vertically therebeneath for cantilevering the frame therefrom.

3. The creel of claim 1 wherein the angle of said wires is about 65° with the plane of said frame structure.

4. The creel of claim 1 wherein said frame comprises a plurality of rib members secured at their ends to each other at right angles to form a rectangular frame, said wires being secured to the frame at its corners.

5. The creel of claim 1 wherein said wires comprise single strand steel of about at least 3/16-inch diameter and said weight is about 100 pounds.

6. The creel of claim 1 wherein the angles of all of the wires are substantially the same.

7. The creel of claim 4 wherein the wires cross at a region vertically spaced from the frame in the plane of a rib member.

8. A creel to be suspended from a support comprising:

a plurality of wires of a given stiffness adapted to be secured to and hang at one end thereof from said support in spaced relation;

a frame member of a given weight lying in a substantially horizontal plane secured to the other ends of said wires and suspended from the support by said wires, said wires being at an angle with said plane; and a plurality of yarn guide members secured to and extending from the frame, said wires being attached to said frame member and support at such an angle and said weight and wire stiffness having such values that horizontal sway of said frame member is minimized in response to horizontal forces on the frame caused by yarn passing through said guide members.

9. The creel of claim 8 wherein said guide members comprise rings each adapted to receive at least one sliver.

* * * * *